US008943727B2

(12) United States Patent
Russell

(10) Patent No.: US 8,943,727 B2
(45) Date of Patent: Feb. 3, 2015

(54) MAGAZINE FOR A FIREARM

(71) Applicant: Shawn H. Russell, Bristol, CT (US)

(72) Inventor: Shawn H. Russell, Bristol, CT (US)

(73) Assignee: Okay Industries, Inc., New Britain, CT (US)

( * ) Notice: Subject to any disclaimer, the term of this patent is extended or adjusted under 35 U.S.C. 154(b) by 128 days.

(21) Appl. No.: 13/693,608

(22) Filed: Dec. 4, 2012

(65) Prior Publication Data

US 2014/0150315 A1 Jun. 5, 2014

(51) Int. Cl.
*F41A 9/61* (2006.01)
*F41A 9/65* (2006.01)

(52) U.S. Cl.
CPC ..... *F41A 9/65* (2013.01)
USPC ..... 42/50; 89/33.1

(58) Field of Classification Search
CPC ..... F41A 9/65
USPC ..... 42/50, 17, 22, 39; 89/33.1
See application file for complete search history.

(56) References Cited

U.S. PATENT DOCUMENTS 4,776,122 A * 10/1988 Dieringer et al. ..... 42/50
2011/0167694 A1* 7/2011 Bigley et al. ..... 42/50

* cited by examiner

*Primary Examiner* — J. Woodrow Eldred
(74) *Attorney, Agent, or Firm* — Alix, Yale & Ristas, LLP

(57) ABSTRACT

A magazine for a firearm is provided. The magazine includes a first wall and a second wall coupled to the first wall to define an enclosure. A first projection extends from a first portion of the first wall, a first end of the first projection being adjacent an end of the first wall, the first projection having a first angled surface opposite the first end. A second projection extends from a second portion of the second wall, a second end of the second projection being adjacent the first end, the second projection having a second angled surface arranged opposite the first angled surface.

15 Claims, 7 Drawing Sheets

MAGAZINE FOR A FIREARM

BACKGROUND

The subject matter disclosed herein relates to a magazine for a firearm and in particular to a magazine for a firearm with increased reliability and reduced need for lubrication.

Firearms having multi-round capabilities typically utilize an interchangeable magazine that holds a predetermined number of ammunition cartridges. Users typically preload several magazines, so that as a magazine becomes depleted during use, the user can quickly exchange the empty magazine with a full one. This allows the user to quickly resume using the firearm with minimal downtime. Magazines typically have a number of sizes, such as magazines holding 10 cartridges, 20 cartridges or 30 cartridges, for example.

Magazines have several components, such as a magazine box that holds the cartridges and a follower that moves the cartridges into the firearm receiver. The follower is typically arranged in the magazine box and is biased by a spring towards the firearm receiver. The pressure of the spring is transferred to the cartridges, which ultimately moves a cartridge into the firearm receiver during operation. One issue that arises is the cartridge misfeeding, particularly with the first cartridge in the magazine. When this occurs, the cartridge becomes stuck partially out of the magazine when the buffer spring in the receiver is unable to overcome the frictional forces on the cartridge. The jamming of the cartridge prevents the firearm from being operated. It should be appreciated that the jamming of the magazine may greatly slow down the usage of the firearm by the user.

To alleviate the misfeed of the cartridge, it is typically recommended that the firearm be cleaned and lubricated frequently. Lubrication of the firearm receiver has been found to reduce the frequency of jamming. United States Government qualification testing for new magazines requires that a firearm be able to fire four consecutive magazines without further lubrication before a misfeed occurs.

While existing magazines for firearms are suitable for their intended purpose, there remains a need for improvements, particularly in increasing the reliability of a firearm and reducing or eliminating the requirement for frequent cleaning and lubrication to prevent ammunition cartridge jamming in the receiver.

SUMMARY

Briefly stated, a magazine for a firearm comprises a first wall and a second wall coupled to the first wall to define an enclosed rectangular cavity. A curved first projection extends from a first portion of the first wall. The end of the first projection is adjacent an end of the first wall. The first projection has a first angled surface opposite the first end. A curved second projection extends from a second portion of the second wall. The end of the second projection is adjacent the first end. The second projection has second angled surface arranged opposite the first angled surface.

The first projection includes a first edge arranged substantially parallel to the first wall. The first projection includes a second edge arranged substantially parallel to the second wall. The first edge and the second edge define a first opening into the enclosed rectangular cavity. A second opening in the enclosed rectangular cavity is defined by the first wall and the second wall and is positioned adjacent the first opening. The second opening is larger than the first opening.

The first angled surface and the second angled surface define a transition opening between the first opening and the second opening. The first angled surface and the first edge define a first point of intersection. The first point of intersection is about 0.785 inches from the first end. The second angled surface and the second edge also define a second point of intersection. The second point of intersection is about 1.050 inches from the second end.

In one embodiment, the first wall, second wall, first projection and second projection are made from aluminum. Alternatively, the first wall, second wall, first projection and second projection are made from steel. In another embodiment, the first wall, second wall, first projection and second projection are made from plastic.

In one embodiment, a magazine for a firearm comprises a first wall having a first end with a first portion and a second portion. The first portion has a first projection and curves about 90 degrees relative to the plane of the first wall. The first projection has a first edge that is substantially parallel to the first wall and a first angled surface extending between the first edge and the second portion. A second wall is coupled to the first wall to define a parallelepiped-shaped container. The second wall has a second end adjacent the first end. The second wall has a third portion adjacent the first portion and a fourth portion adjacent the second portion. The third portion has a second projection that curves about 90 degrees relative to the plane of the second wall and towards the first projection. The second projection has a second edge that is substantially parallel to the first edge and a second angled surface extending between the second edge and the fourth portion.

The first portion and the third portion define a first opening. The second portion and the fourth portion define a second opening larger than the first opening. The first edge has a length less than or equal 0.785 inches. The second edge also has a length less than or equal 0.785 inches.

A first fillet extends between the first angled surface and a second fillet extends between the second angled surface and the fourth portion. The first fillet and the first angled surface define a first point of intersection. The first point of intersection is about 1.05 inches from an opposite end of the first portion. In addition, the second fillet and second angled surface define a second point of intersection. The second point of intersection is about 1.05 inches from an opposite end of the second portion.

In one embodiment, a magazine for a firearm comprises a pair of sidewalls coupled together to define an enclosed cavity sized to receive ammunition cartridges. A pair of opposing projections extends from an end of the pair of sidewalls. Each of the opposing projections curves about 90 degrees toward the center of the magazine. Each of the pair of opposing projections has an edge extending about 0.785 inches from a second of the pair of sidewalls. Each pair of opposing projections has an angled surface extending from the edge and away from the center of the magazine. Each of the angled surfaces has a third end about 1.05 inches from the second end.

The pair of sidewalls defines an opening having a first portion between the edges and a second portion between the third end and a fourth end opposite the first end. The angled surfaces define a transition opening between the first portion and the second portion. The enclosed area is sized to receive 30 ammunition cartridges in one embodiment and to receive 20 ammunition cartridges in another embodiment.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 4:
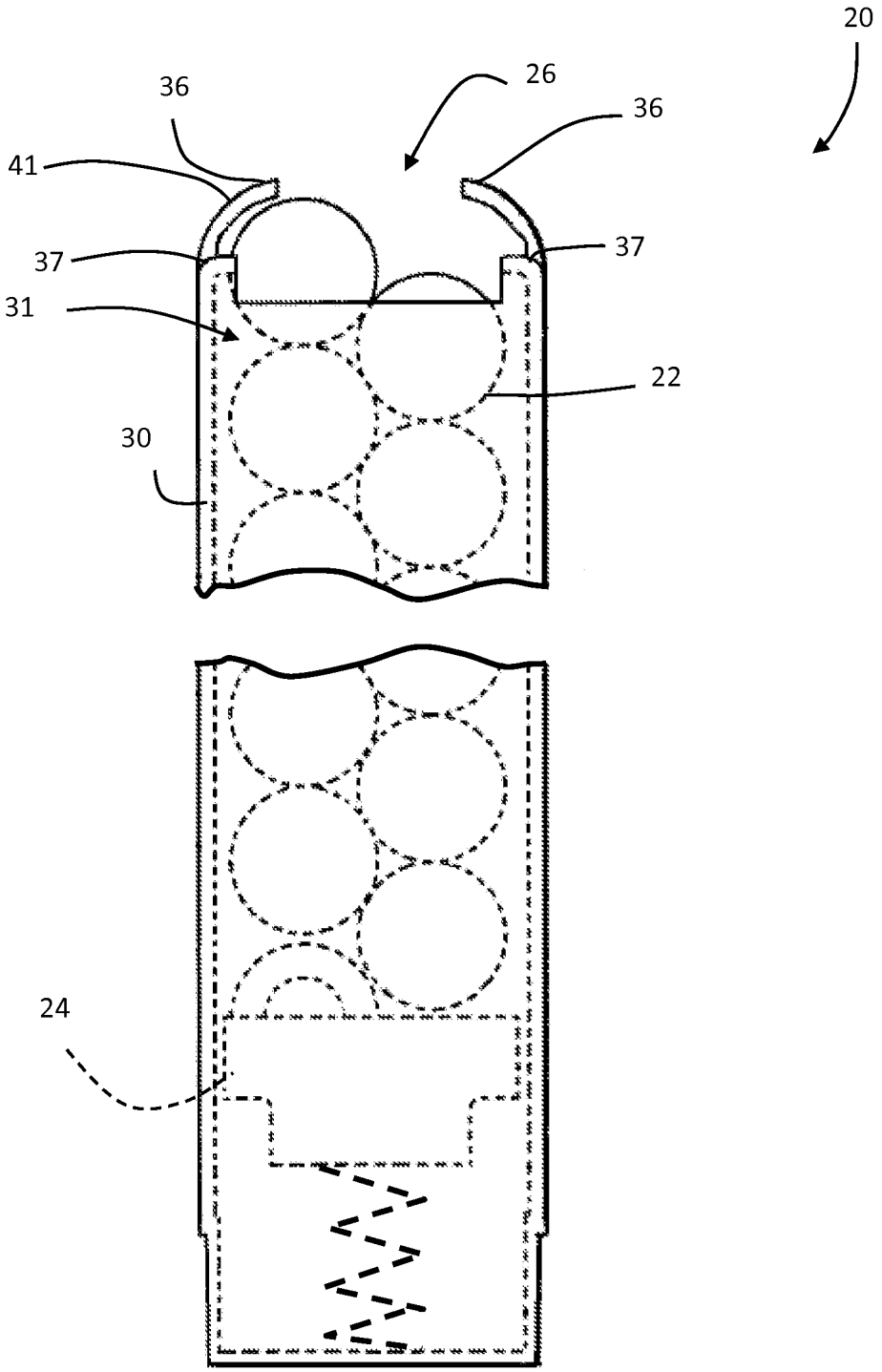
FIG. 4 is a side view, portions in phantom, of the magazine of FIG. 1 with cartridges inserted into the magazine.
Figure 5:
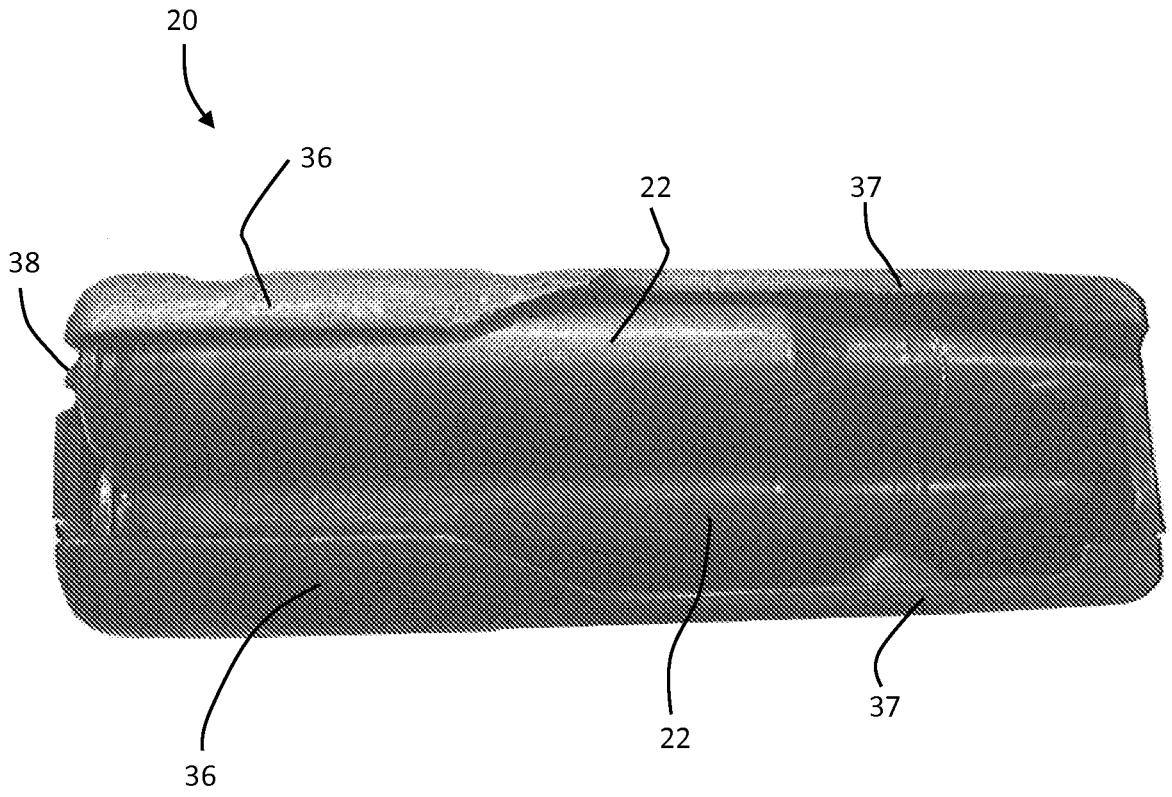
FIG. 5 is a top view of the loaded magazine of FIG. 4.

FIGS. 1-5 illustrate an exemplary embodiment of the magazine 20 for a firearm (not shown). While the magazine 20 may be described herein with respect to a rifle, such as an M-16 or an AR-15 type of rifle for example, the claimed invention should not be so limited and the magazine 20 may be used with any of numerous types of firearms. Magazines 20 of this type are generally interchangeable within a particular model firearm such that the user may fill several magazines with ammunition cartridges 22 (FIG. 4). During use, the cartridges 22 are moved by a follower 24 and sequentially exit through a top opening 26 in a magazine box 28, at which point the cartridge 20 moves into the receiver section of the firearm (not shown). When the magazine 20 is depleted, the follower 24 is disposed adjacent the opening 26. The user may desire to exchange the depleted magazine 20 for a full magazine. It should be appreciated that the magazine 20 is intended to hold a predetermined number of cartridges 22, such as 10, 20 or 30 cartridges, for example.

The magazine 20 has a magazine box 28 that is configured to be received by the firearm. The magazine box 28 may be straight along its length or have a curvature. The magazine box 28 includes the opening 26 and is generally formed from a metal material, such as aluminum or steel, or a molded plastic for example. The magazine box 28 may be made from sheet metal that forms walls 30 which define a generally hollow interior portion 31. The magazine box 28 may include a number of features, such as recesses 32 for example, that allow the magazine box 26 to guide the cartridges into a proper position within the magazine box 26. In one embodiment, the wall of the recesses may be flattened at one side within the interior portion.

On one end 34 of the magazine box 23, the walls 30 turn inward towards the center of the magazine to form a pair of lip-like tabs or projections 36. In the exemplary embodiment, the projections 36 have a curved portion 41 which extends 90 degrees relative to the walls 30. The projections extend from one end 38 of the magazine box 28 and extend laterally along the wall 30 toward the center of the magazine box 23. In the exemplary embodiment, the end 38 of the projections 36 is planar or co-linear with the end 40 of the magazine box. In another embodiment, the end 38 may be offset from the end 40 towards the center of the magazine box 28.

Adjacent the projections 36, walls 30 may also turn inward to form a second pair of projections 37. The second pair of projections 37 is spaced apart laterally by a distance x (FIG. 2) from the end of the projections 36 to form a step on the end of the magazine box 28. In the exemplary embodiment, the end 40 may have an extending raised portion 42.

The projections 36 have a second end 44 opposite the end 40 that is centrally disposed relative to the opening 26. In the exemplary embodiment, the second end 44 includes an angled surface 46 that transitions an inner edge 48 from a narrow portion 50 to a wider portion 52 such that the space between the projections 36 enlarges as the projections extend toward the central portion of the magazine box 28. The angled surface 46 has a first end 56 at distance 58 from the end 38 and a second end 60 at a distance 62 from the end 38.

In the exemplary embodiment for magazine 20, the distance d is approximately 0.785 inches (19.939 millimeters) and the distance D is approximately 1.05 inches (26.695 millimeters). In one embodiment, the end 60 includes a curved surface or fillet 47 that transitions between the angled surface 46 and the wider portion 52. The foregoing dimensions for some embodiments can vary ±0.125 inches and still provide the beneficial characteristics of reducing misfeeding or jamming a cartridge during operation.

It should be appreciated that the surface 46 appears to be a straight linear surface when viewed from the top of the magazine. However, since the projections includes a curved surface 41 that bends the projections 90 degrees towards the centerline of the magazine, the surface 46 may also include some curvature. Further, the ends 56, 60 may have a radius, or may be a sharp edge.

Figure 6:
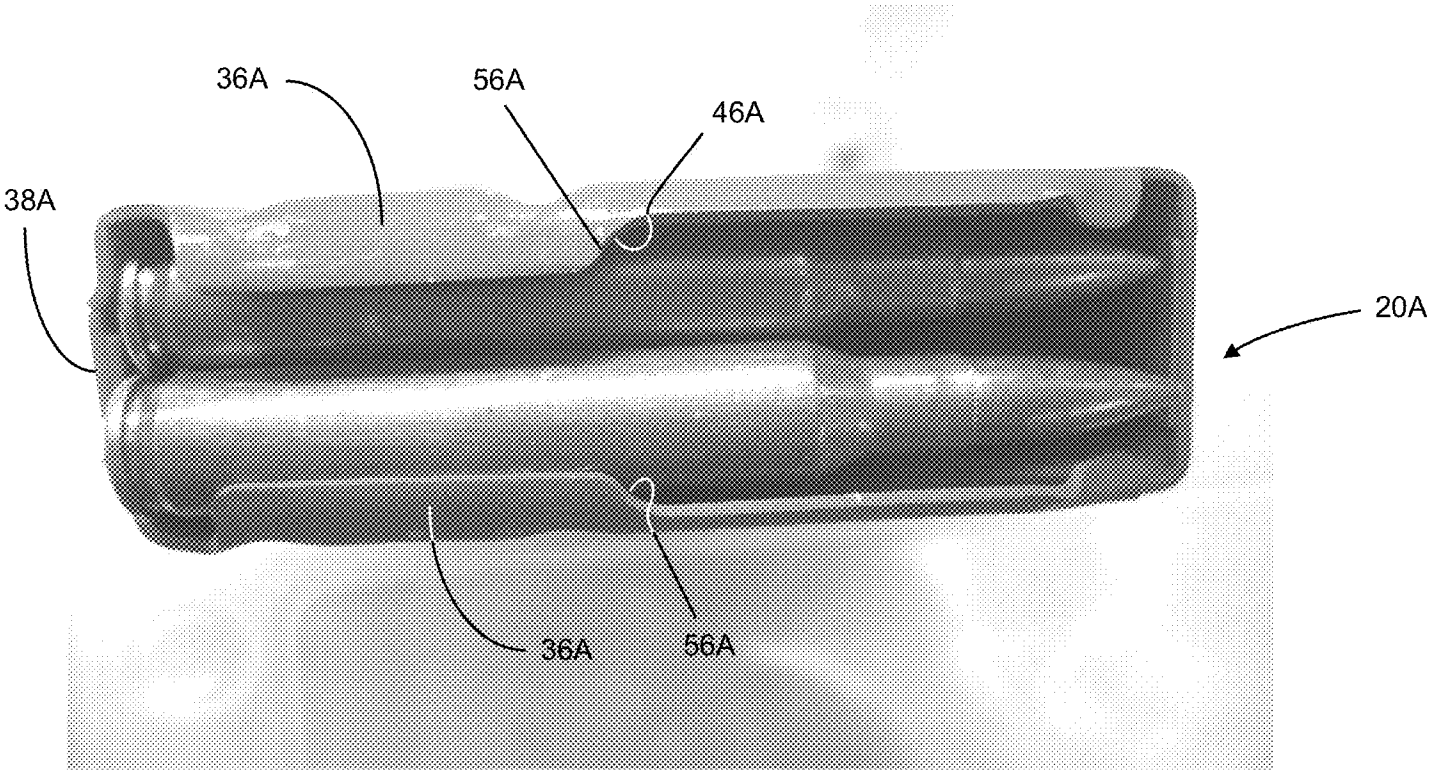
FIG. 6 is a top view of another embodiment of a loaded magazine.
Figure 7:
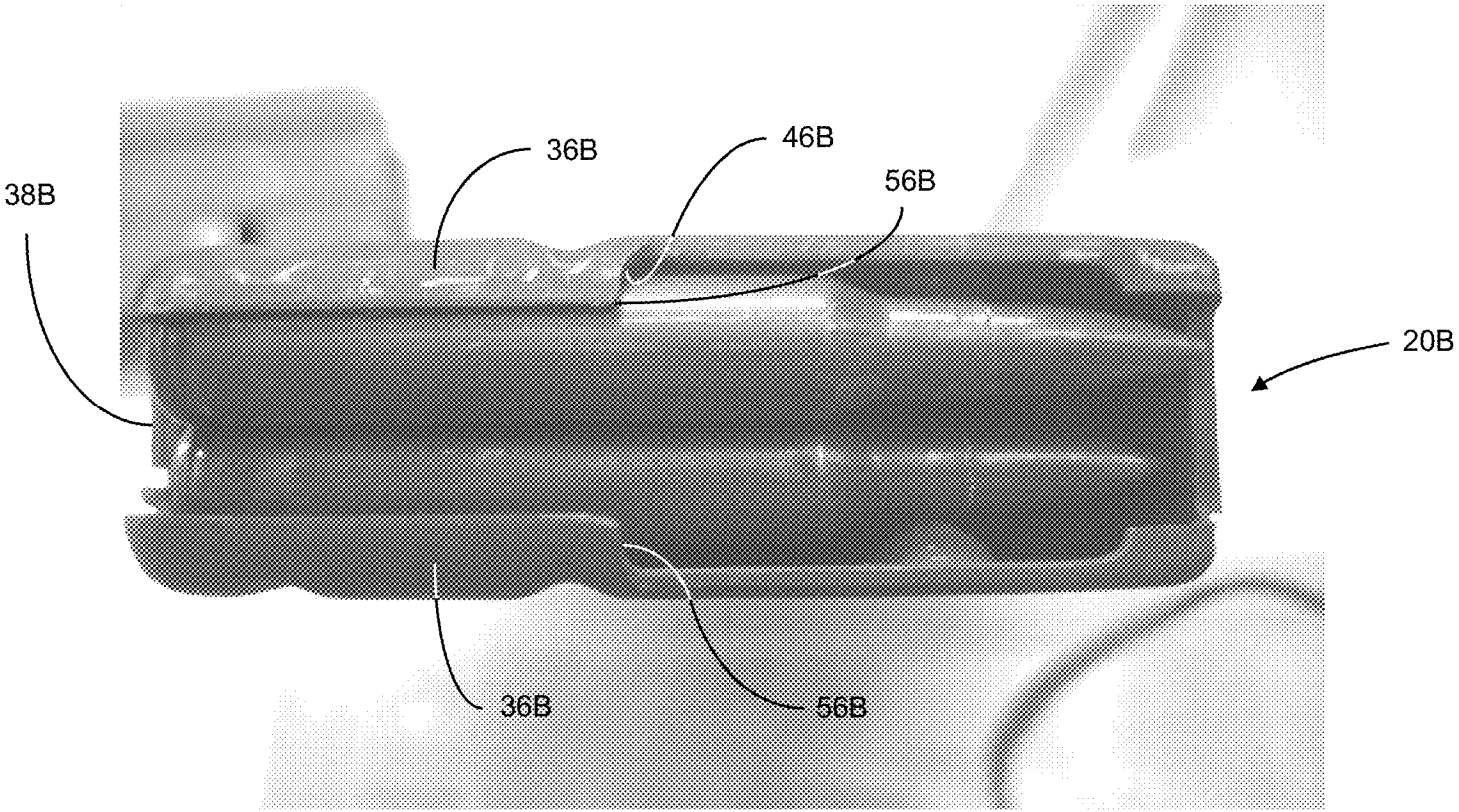
FIG. 7 is a top view of yet another embodiment of a loaded magazine.

With reference to FIGS. 6 and 7, other magazine/projection configurations are also possible. Magazine 20A is configured for 20 cartridges. The magazine projections 36A do not extend to the end 38A of the magazine so that the back rim of the bullet is exposed as viewed from the top. Magazine 20B is configured for 30 cartridges. The respective projections 36A, 36B extend to the end 38B of the magazine.

Figure 1:
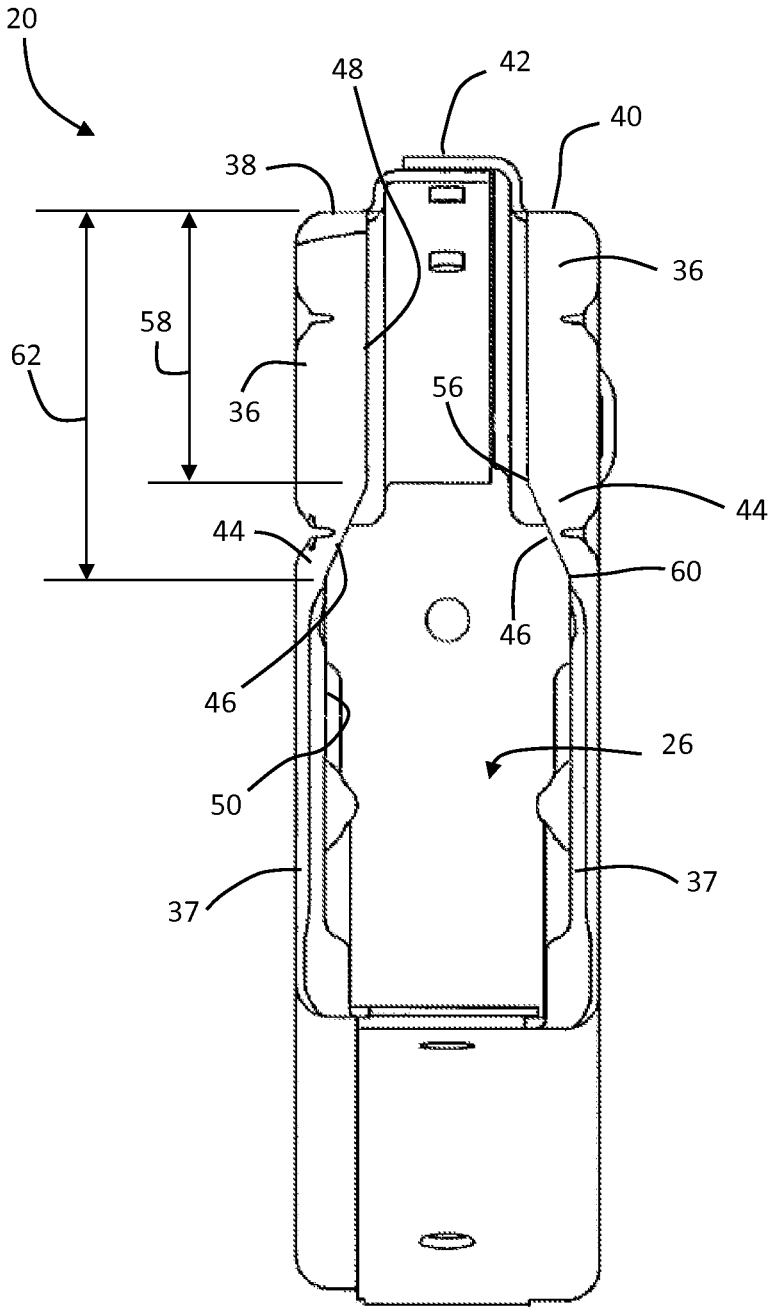
FIG. 1 is top plan view of a magazine with portions shown in phantom for an alternative embodiment.
Figure 2:
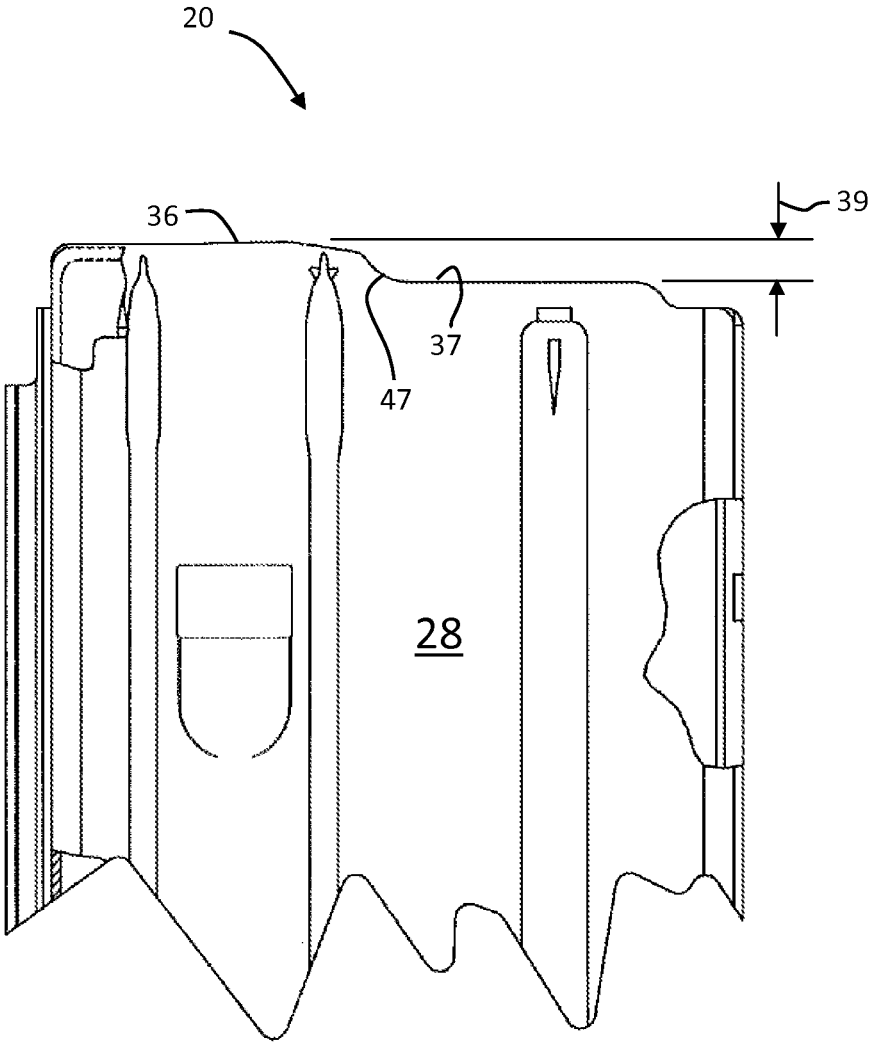
FIG. 2 is a partial front view of the magazine of FIG. 1 with portions shown in phantom for an alternative embodiment.
Figure 3:
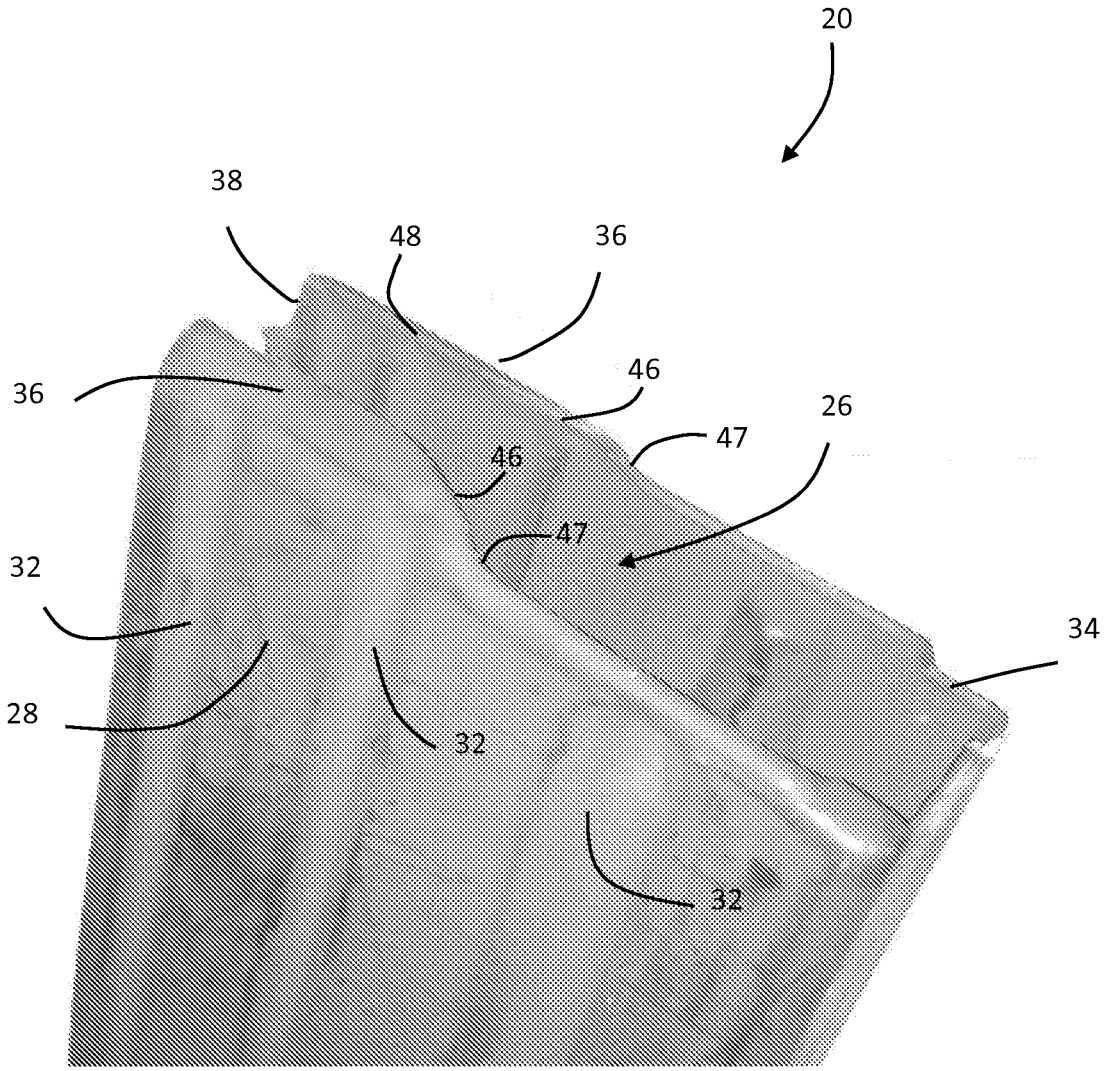
FIG. 3 is a partial perspective view of the magazine of FIG. 1.

For magazines 20A and 20B, the apex at the forward end of the points 56A and 56B is approximately 0.228 further toward the front of the bullet than that of magazine 20 in FIG. 1. The angle of surfaces 46A and 46B is approximately 72 degrees as opposed to the 25 degree angle of surface 47 for magazine 20. The angle of fillet 47A, 47B as viewed in FIG. 2 is approximately 45 degrees for magazines 20A and 20B as opposed to the corresponding angle of approximately 23 degrees for magazine 20, as viewed in FIG. 2.

The angled surfaces 46, 46A and 46B have been found to be advantageous in reducing the potential for misfeeding or jamming of the cartridge during operation such that a substantially greater number of magazines may be sequentially fired from the firearm without having to lubricate or clean the magazine. Prior magazine designs had a projection that extended uniformly from end to end (e.g., no angled surface). Magazines 20, 20A and 20B which incorporate the projections 36, 36A and 36B and other features as previously described require less force to eject bullets from the magazine and into the barrel chamber.

United States Governmental standards permit lubrication of the firearm after every fourth magazine that is discharged (approximately 120 rounds). Embodiments of magazine 20 have been tested by firing 200 magazines sequentially without any occurrence of jamming or misfeeding in full auto 30 round burst M-16 firearms with no lubrication during the testing.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A magazine for a firearm comprising:

a first wall;

a second wall coupled to the first wall to define an enclosure to receive ammunition cartridges and an elongated cartridge exit opening comprising a first opening portion, a second opening portion and a transition opening portion;

a curved first projection extending from a first portion of the first wall and including a first edge substantially parallel to the first wall, a first end of the first projection being adjacent an end of the first wall, the first projection having a first angled surface opposite the first end and having a first angled edge oriented at an acute angle to said first edge;

a curved second projection extending from a second portion of the second wall and including a second edge substantially parallel to the second wall, a second end of the second projection being adjacent the first end, the second projection having a second angled surface arranged opposite the first angled surface and having a second angled edge oriented at an acute angle to said second edge;

the first opening portion defined by said first edge and said second edge;

the second opening portion defined by the first wall and the second wall, the second opening portion being larger than the first opening portion; and the transition opening portion defined by the first angled edge and the second angled edge, said transition opening gradually transitioning from a narrow gap to a wider gap between the first opening portion and the second opening portion.

2. The magazine of claim 1 wherein the first angled surface and the first edge define a first point of intersection, the first point of intersection being about 0.785 inches from the first end.

3. The magazine of claim 2 wherein the second angled surface and the second edge define a second point of intersection, the second point of intersection being about 0.785 inches from the second end.

4. The magazine of claim 3 wherein the first wall, second wall, first projection and second projection are made from aluminum.

5. The magazine of claim 3 wherein the first wall, second wall, first projection and second projection are made from steel.

6. The magazine of claim 3 wherein the first wall, second wall, first projection and second projection are made from plastic.

7. A magazine for a firearm comprising:

a generally parallelepiped container comprising a first wall and a second wall and defining an exit opening comprising a first opening, a second opening and a transition opening at a top portion thereof;

the first wall defining a first plane and having a first end with a first portion and a second portion, the first portion having a first projection that curves about 90 degrees relative to the first plane, the first projection having a first edge that is substantially parallel to the first wall and a first angled surface having a first angled edge oriented at an acute angle to said first edge and extending between the first edge and the second portion; and the second wall defining a second plane the second wall having a second end adjacent the first end, the second wall having a third portion adjacent the first portion and a fourth portion adjacent the second portion, the third portion having a second projection that curves about 90 degrees relative to the second plane and towards the first projection, the second projection having a second edge that is substantially parallel to the first edge and a second angled surface having a second angled edge oriented at an acute angle to said second edge and extending between the second edge and the fourth portion, wherein the first portion and the third portion define the first opening, and the second portion and the fourth portion define the second opening, and the transition opening being defined between the first and second angled edges and between the first and second openings, said transition opening gradually transitioning from a narrow gap to a wider gap between the first opening and the second opening.

8. The magazine of claim 7 wherein the first edge has a length of less than or equal to 0.785 inches.

9. The magazine of claim 8 wherein the second edge has a length of less than or equal to 0.785 inches.

10. The magazine of claim 9 further comprising a first fillet between the first angled surface and a second fillet between the second angle surface and the fourth portion.

11. The magazine of claim 10 wherein the first fillet and the first angled surface define a first point of intersection, the first point of intersection being about 1.05 inches from an opposite end of the first portion.

12. The magazine of claim 11 wherein the second fillet and the second angled surface define a second point of intersection, the second point of intersection being about 1.05 inches from an opposite end of the second portion.

13. A magazine for a firearm comprising:

a pair of side walls joined to define an enclosed region sized to receive ammunition cartridges;

a pair of opposing projections extending from a first end of the pair of side walls, each of the pair of opposing projections curving about 90 degrees toward a center of the magazine, each of the pair of opposing projections having an edge extending from a second end of the pair of side walls, each pair of opposing projections further having an angled surface extending at an acute angle from the edge and away from the center of the magazine, wherein the pair of side walls define an opening having a first portion between the edges and a second portion between the third end and a fourth end opposite the first end, and wherein the angled surfaces define a transition opening which continuously increases in width between the first portion and the second portion.

14. The magazine of claim 13 wherein the enclosed region is sized to receive 30 ammunition cartridges.

15. The magazine of claim 13 wherein the enclosed region is sized to receive 20 ammunition cartridges.

* * * * *